US007264044B2

(12) United States Patent
Chu et al.

(10) Patent No.: US 7,264,044 B2
(45) Date of Patent: Sep. 4, 2007

(54) HEAT EXCHANGE STRUCTURE

(75) Inventors: Cheng-Kun Chu, Tucheng (TW); Yen-Hsi Lin, Taipei (TW); Shin-Chieh Chen, Taoyuan (TW)

(73) Assignee: Taiwan Textile Research Institute, Taipei Hsien (TW)

( * ) Notice: Subject to any disclaimer, the term of this patent is extended or adjusted under 35 U.S.C. 154(b) by 61 days.

(21) Appl. No.: 11/193,080

(22) Filed: Jul. 29, 2005

(65) Prior Publication Data

US 2006/0144575 A1 Jul. 6, 2006

(30) Foreign Application Priority Data

Jan. 3, 2005 (TW) ..... 94100098 A

(51) Int. Cl.
*F28F 21/00* (2006.01)

(52) U.S. Cl. ..... 165/133; 165/166; 165/905

(58) Field of Classification Search ..... 165/133, 165/165, 166, 905
See application file for complete search history.

(56) References Cited

U.S. PATENT DOCUMENTS 3,395,900 A * 8/1968 Meek ..... 261/29
3,395,903 A * 8/1968 Norback et al. ..... 261/112.2
3,500,615 A * 3/1970 Meek ..... 96/300
3,862,280 A * 1/1975 Polovina ..... 261/112.2
3,982,981 A * 9/1976 Takao et al. ..... 165/166
4,157,929 A * 6/1979 Kubicek ..... 165/166
5,248,454 A * 9/1993 Thomas ..... 261/112.2
6,951,242 B1 * 10/2005 Des Champs et al. ..... 165/164
2003/0094269 A1 * 5/2003 Arai et al. ..... 165/166

FOREIGN PATENT DOCUMENTS

JP 58-88599 * 5/1983 ..... 165/166

* cited by examiner

*Primary Examiner*—Teresa J. Walberg
(74) *Attorney, Agent, or Firm*—Patterson & Sheridan, L.L.P.

(57) ABSTRACT

A heat exchange structure includes at least three wave-shaped non-woven cloth layers. Each wave-shaped non-woven cloth layer has a plurality of crest tops and trough bottoms. Adjacent wave-shaped non-woven cloth layers are interconnected at intersections of crest tops and trough bottoms thereof. Each wave-shaped non-woven cloth layer forms a unique flow channel. When a cool airflow and a hot airflow are respectively introduced into flow channels formed by adjacent wave-shaped non-woven cloth layers, a heat exchange is executed at the wave-shaped non-woven cloth layer between the cool airflow and the hot airflow.

7 Claims, 3 Drawing Sheets

HEAT EXCHANGE STRUCTURE

CROSS-REFERENCE TO RELATED APPLICATIONS

The present application is based on, and claims priority from, Taiwan Application Ser. No. 94100098, filed Jan. 3, 2005, the disclosure of which is hereby incorporated by reference herein in its entirety.

BACKGROUND OF THE INVENTION

1. Field of the Invention

The present invention relates to a heat exchange structure. More particularly, the present invention relates to a heat exchange structure adapted for gases.

2. Description of the Related Art

A heat exchange structure is an important component in several kinds of air conditioners. Any kind of refrigerator or air conditioner must have a heat exchange structure to execute a heat exchange process so that the heat in the refrigerator or air conditioner can be carried out effectively.

A conventional refrigerator or air conditioner has a heat exchange structure, which is made of metal materials and in which a heat exchange process between gas and liquid is executed. For example, refrigerant in a refrigerator vaporizes and absorbs heat. The refrigerant is carried to the heat exchange structure to release the heat by means of a compressor.

The larger a heat exchange area is, the more effective a heat exchange process is. Thus, the refrigerator or air conditioner should have a large heat exchange area. In order to limit the size of an exchange structure, particular structure designs, such as a honeycomb pattern, are applied to increase the heat exchange area without increasing the overall volume.

Metal materials are good thermal conductors, but they are quite heavy (i.e. have a large density), and some applications need a heat exchange structure made of light material. Heat exchange structures made of metal materials, therefore, are not suitable.

For the foregoing reasons, manufacturers aggressively seek solutions to overcome the above-mentioned dilemma.

SUMMARY OF THE INVENTION

It is therefore an objective of the present invention to provide a lightweight heat exchange structure.

In accordance with the foregoing and other objectives of the present invention, a heat exchange structure includes at least three wave-shaped non-woven cloth layers. Each wave-shaped non-woven cloth layer has a plurality of crest tops and trough bottoms. Adjacent wave-shaped non-woven cloth layers are interconnected at intersections of their crest tops and trough bottoms. Each wave-shaped non-woven cloth layer forms a unique flow channel. When a cool airflow and a hot airflow are respectively introduced into flow channels formed by adjacent layers, a heat exchange is executed at the layer between the cool airflow and the hot airflow.

According to one preferred embodiment of present invention, the preferred scopes of critical physical features are set forth as follows: a density of the non-woven cloth layer is not less than 150 g/cm$^2$; a permeability rate of the non-woven cloth layer is not less than 20 cc/cm$^2$/m$^3$; and a thickness of the wave-shaped non-woven cloth layer is not more than 50 μm.

Thus, the heat exchange structure, composed of wave-shaped non-woven cloth layers and flow channels of different directions, performs an effective heat exchange process and weighs less than a heat exchange structure made of metal materials. The non-woven cloth layers may further include an anti-bacterial film deposited on the cloth fibers so as to clean the air passing between the fibers.

It is to be understood that both the foregoing general description and the following detailed description are by examples and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION OF THE PREFFERED EMBODIMENT

Figure 1:
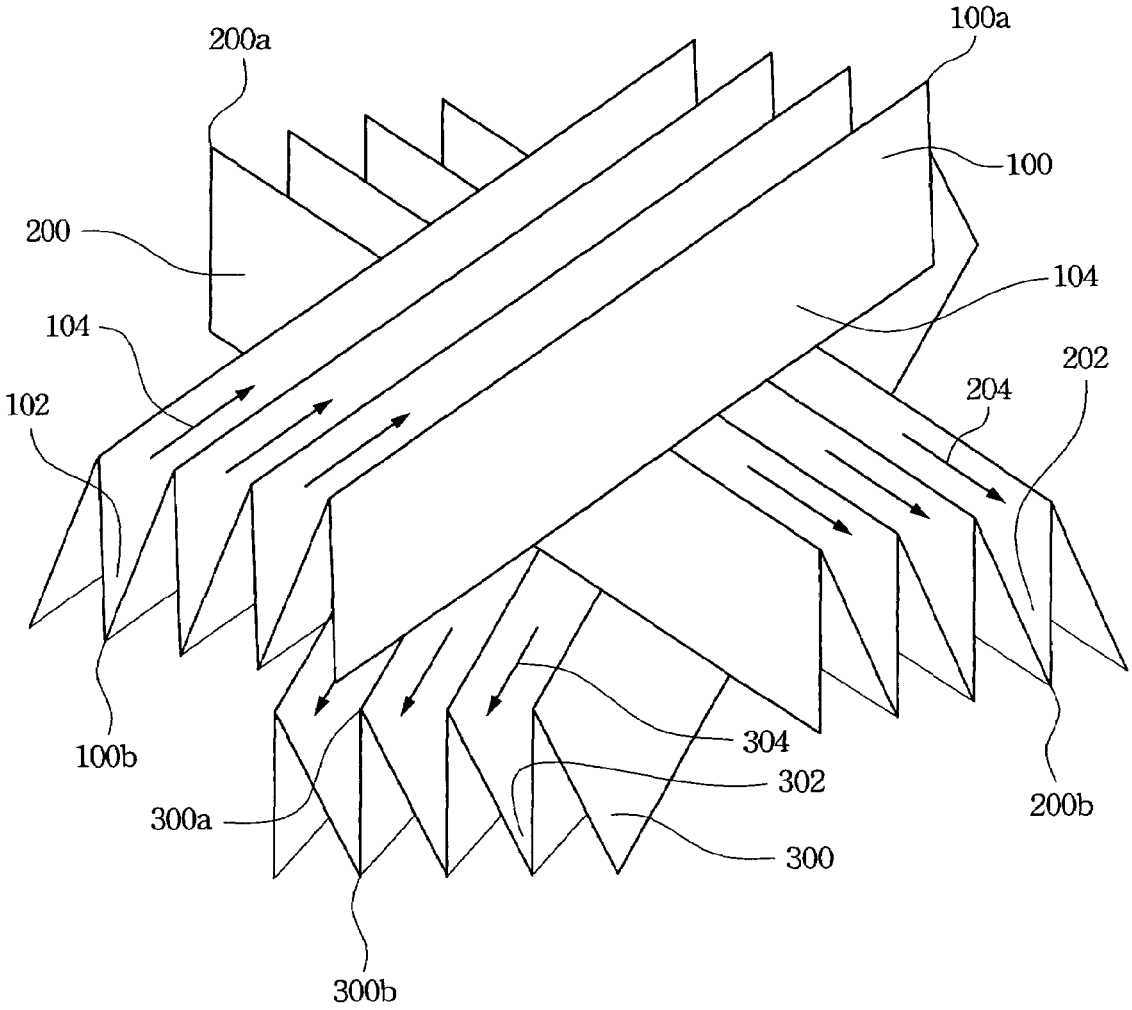
FIG. 1 illustrates a perspective view of a heat exchange structure according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

In order to provide a lightweight heat exchange structure (in comparison with the heat exchange structure made of metal materials), the present invention discloses a heat exchange structure composed of non-woven cloth layers. The non-woven cloth layers are manufactured as wave-shaped structures. At least three wave-shaped non-woven cloth layers are secured together, wherein each non-woven cloth layer forms a flow channel of a unique direction. A cool airflow and a hot airflow are respectively introduced into flow channels formed by adjacent wave-shaped non-woven cloth layers.

FIG. 1 illustrates a perspective view of a heat exchange structure according to one preferred embodiment of this invention. The heat exchange structure includes three non-woven cloth layers 100, 200 and 300, each forming a flow channel of a unique direction. Each non-woven cloth layer is manufactured as a wave-shaped structure so that each has a plurality of crest tops and trough bottoms. For example, the non-woven cloth layer 100 has a plurality of crest tops 100*a* and trough bottoms 100*b*. Adjacent non-woven cloth layers are interconnected at the intersections of their crest tops and trough bottoms. For example, adjacent non-woven cloth layers 100 and 200 are interconnected at the intersections of trough bottoms 100*b* and crest tops 200*a*. When a cool airflow and a hot airflow are respectively introduced into flow channels formed by adjacent layers, a heat exchange is executed at the permeable layer between the cool airflow and the hot airflow. For example, a hot airflow is introduced into troughs (flow channels) 102 of the non-woven cloth layer 100 and a cool airflow is introduced into troughs (flow channels) 202 of the non-woven cloth layer 200, thereby creating a heat exchange at the permeable non-woven cloth layer 100 between the cool airflow and the hot airflow. Although, this preferred embodiment includes three non-woven cloth layers, more than three non-woven cloth layers (each forming a flow channel of a unique direction) can be easily secured together to achieve similar results according to disclosures in this preferred embodiment.

Figure 2:
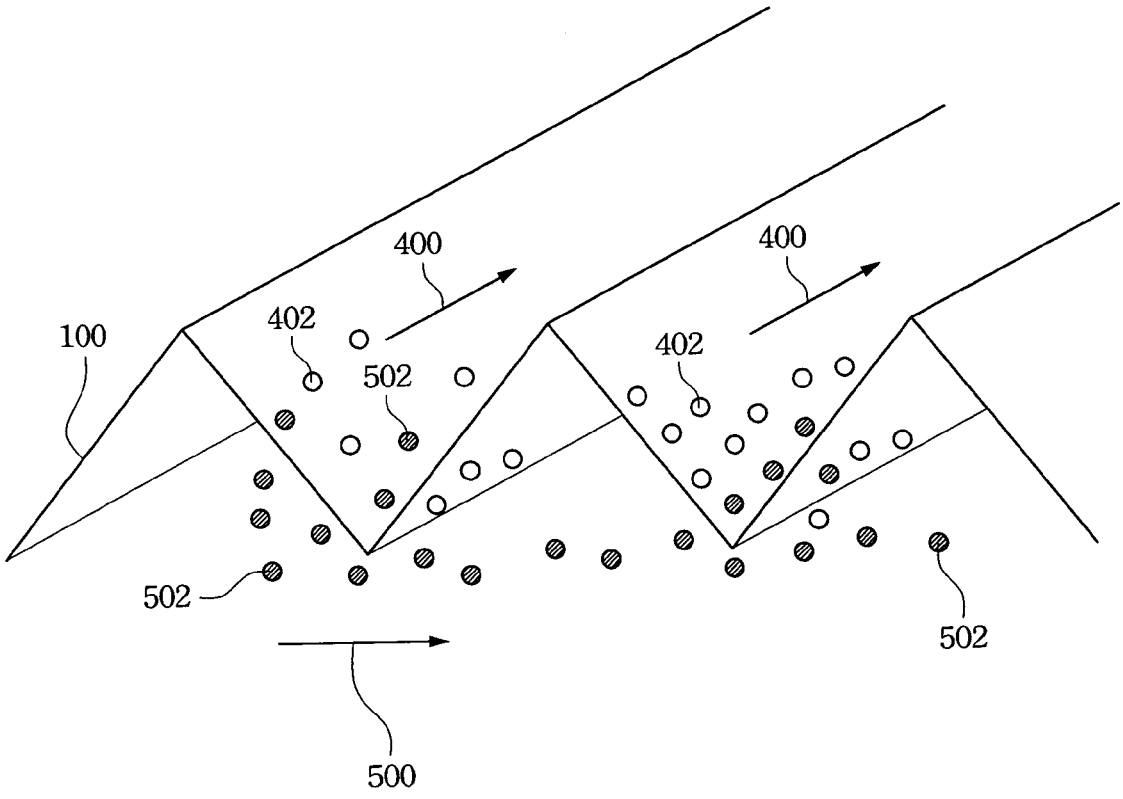
FIG. 2 illustrates a detailed view of how a heat exchange process is executed at a non-woven cloth layer according to one preferred embodiment of this invention.

FIG. 2 illustrates a detailed view of how a heat exchange process is executed at a non-woven cloth layer according to one preferred embodiment of this invention. When cool air particles 402 move along a flow direction 400, a portion of the cool air particles 402 penetrate the permeable non-woven cloth layer 100 and arrive in the flow channel underneath the non-woven cloth layer 100. When hot air particles 502 move along a flow direction 500, a portion of the hot air particles 502 easily collide with the non-woven cloth layer 100 and penetrate it because the flow directions 400 and 500 are not parallel. This is the reason why adjacent non-woven cloth layers need to form flow channels of a unique direction. Because the non-woven cloth layer is positioned between the hot flow channel and the cool flow channel, its physical features are particularly critical. By experimental deduction, a density, a thickness, a permeability rate or any combination thereof of the non-woven cloth layer effectively influence a heat exchange process. The preferred scopes of these physical features are set forth as follows: a density of the non-woven cloth layer is not less than 150 $g/cm^2$; a permeability rate of the non-woven cloth layer is not less than 20 $cc/cm^2/m^3$; and a thickness of the wave-shaped non-woven cloth layer is not more than 50 μm.

Figure 3:
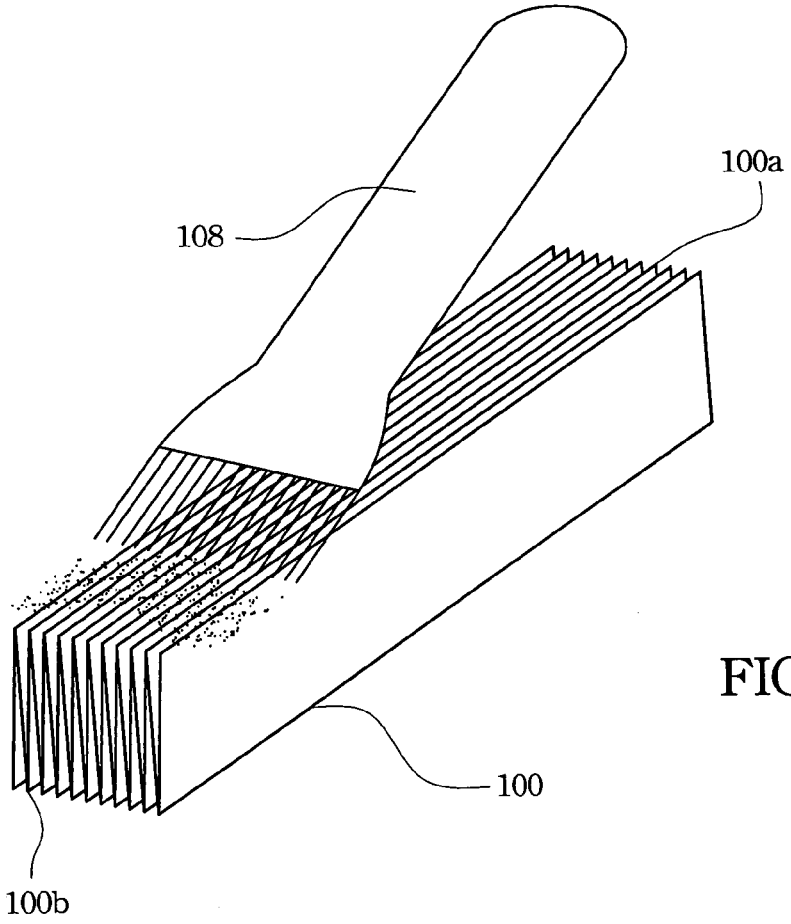
FIG. 3 illustrates a perspective view of how an adhesive is spread on the crest tops and trough bottoms of a wave-shaped non-woven cloth layer according to one preferred embodiment of this invention.

FIG. 3 illustrates a perspective view of how adhesives are spread on the crest tops and trough bottoms of a wave-shaped non-woven cloth layer according to one preferred embodiment of this invention. There are so many interconnection areas respectively on crest tops and trough bottoms of a non-woven cloth layer that separately disposing an adhesive on each small interconnection area is quite inconvenient (refer to FIG. 1). Thus, each non-woven cloth layer is tightly folded like the non-woven cloth layer 100 illustrated in FIG. 3. Adhesives are then spread on crest tops 100*a* and trough bottoms 100*b* at the same time by means of a brush 108 so as to avoid inconveniences of separately disposing an adhesive on each small interconnection area.

Figure 4:
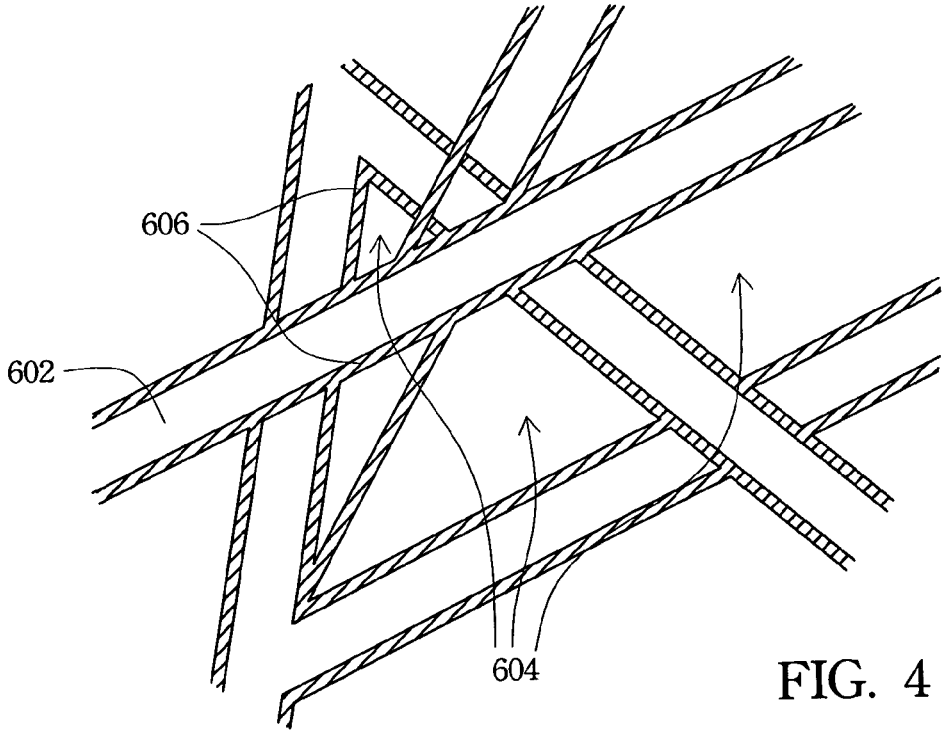
FIG. 4 illustrates a detailed view of a non-woven cloth layer, having an anti-bacterial film deposited thereon, according to one preferred embodiment of this invention.

FIG. 4 illustrates a detailed view of a non-woven cloth layer, having an anti-bacterial film deposited thereon, according to one preferred embodiment of this invention. The non-woven cloth layer may be soaked in an anti-bacterial liquid so that an anti-bacterial film 606 is coated or deposited on each of the non-woven cloth fibers 602. When a cool airflow or a hot airflow passes through gaps 604 among non-woven cloth fibers 602, bacteria that are stuck on the anti-bacterial film 606 can be easily killed. Therefore, the non-woven cloth layer may include a new functionality of air cleansing by means of the anti-bacterial film.

According to the above preferred embodiments, the heat exchange structure, composed of wave-shaped non-woven cloth layers and flow channels of different directions, performs an effective heat exchange process and weighs less than a heat exchange structure made of metal materials. The non-woven cloth layers may further include an anti-bacterial film deposited on non-woven cloth fibers so as to clean the air passing between said non-woven cloth fibers.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. A heat exchange structure comprising at least three wave-shaped non-woven cloth layers, each said wave-shaped non-woven cloth layer having a plurality of crest tops and trough bottoms, adjacent wave-shaped non-woven cloth layers being interconnected at intersections of said crest tops and trough bottoms thereof, wherein each said wave-shaped non-woven cloth layer forms a unique flow channel, and a heat exchange is executed at said wave-shaped non-woven cloth layer when a cool airflow and a hot airflow are respectively introduced into flow channels formed by adjacent wave-shaped non-woven cloth layers.

2. The heat exchange structure of claim 1, wherein a density of said wave-shaped non-woven cloth layer is not less than 150 $g/cm^2$.

3. The heat exchange structure of claim 2, wherein a permeability rate of said wave-shaped non-woven cloth layer is not less than 20 $cc/cm^2/m^3$.

4. The heat exchange structure of claim 3, wherein a thickness of said wave-shaped non-woven cloth layer is not more than 50 μm.

5. The heat exchange structure of claim 1, wherein a permeability rate of said wave-shaped non-woven cloth layer is not less than 20 $cc/cm^2/m^3$.

6. The heat exchange structure of claim 1, wherein a thickness of said wave-shaped non-woven cloth layer is not more than 50 μm.

7. The heat exchange structure of claim 1, wherein each said wave-shaped non-woven cloth layer is composed of a plurality of non-woven cloth fibers, wherein an anti-bacterial film is deposited on each of said non-woven cloth fibers so as to clean air passing between said non-woven cloth fibers.

* * * * *